United States Patent [19]

Del Zotto et al.

[11] Patent Number: 4,922,463

[45] Date of Patent: May 1, 1990

[54] PORTABLE VOLUMETRIC CONCRETE MIXER/SILO

[75] Inventors: William Del Zotto, Ocala, Fla.; Jerry Lewis, Duluth, Minn.

[73] Assignee: Del Zotto Manufacturing Co., Duluth, Minn.

[21] Appl. No.: 234,908

[22] Filed: Aug. 22, 1988

[51] Int. Cl.[5] ..... B28C 7/06; B01F 13/02; B01F 15/00; B01F 15/02

[52] U.S. Cl. ..... 366/21; 366/27; 366/34; 366/37; 366/50; 366/64; 366/101; 366/107; 366/134; 366/143; 366/152; 366/154; 366/160; 366/177; 366/182; 366/186; 366/193; 366/196; 366/271; 222/189; 222/195; 222/410; 222/415

[58] Field of Search ..... 366/3, 5, 8–11, 366/13, 16, 17–21, 27–34, 37, 42, 43, 49, 50, 52, 64–67, 101–104, 107, 114, 134, 143, 152, 154, 160, 177, 181, 182, 186, 193, 196, 271; 222/136, 145, 189, 195, 405, 409, 410, 415; 52/192, 194, 197; 406/90, 91; 414/176, 302

[56] References Cited

U.S. PATENT DOCUMENTS

| | | | |
|---|---|---|---|
| 831,658 | 9/1906 | Ericsson | 366/33 |
| 935,782 | 10/1909 | Demorest | 222/136 |
| 1,823,343 | 9/1931 | Billner | 366/3 |
| 2,284,975 | 6/1942 | Horner | 222/405 |
| 2,511,246 | 6/1950 | Chamberlin | 222/405 |
| 2,741,401 | 4/1956 | Kehres et al. | 366/16 |
| 2,873,036 | 2/1959 | Noble | 366/20 |
| 2,946,597 | 7/1960 | Simonsen | 222/136 |
| 3,153,494 | 10/1964 | Heider | 222/136 |
| 3,215,408 | 11/1965 | Hansen | 366/160 |
| 3,237,805 | 3/1966 | Stogner | 366/3 |
| 3,363,806 | 1/1968 | Blakeslee et al. | 366/114 |
| 3,398,662 | 8/1968 | Takata et al. | 222/189 |
| 3,424,438 | 1/1969 | Knotts et al. | 366/101 |
| 3,667,736 | 6/1972 | Carroll | 366/27 |
| 3,705,710 | 12/1972 | Mueller | 366/11 |
| 3,746,313 | 7/1973 | Weeks et al. | 366/19 |
| 4,285,598 | 8/1981 | Horton | 366/27 |
| 4,298,288 | 11/1981 | Weisbrod | 366/27 |
| 4,403,864 | 9/1983 | Stastny | 366/64 |
| 4,406,548 | 9/1983 | Haws | 366/8 |
| 4,411,674 | 10/1983 | Forgac | 406/90 |
| 4,579,459 | 4/1986 | Zimmerman | 366/50 |
| 4,624,575 | 11/1986 | Lantz | 366/16 |
| 4,655,603 | 4/1987 | Palm | 366/107 |
| 4,783,171 | 11/1988 | Zimmerman | 366/50 |

FOREIGN PATENT DOCUMENTS

| | | | |
|---|---|---|---|
| 1189670 | 7/1985 | Canada | 52/197 |
| 2259752 | 6/1973 | Fed. Rep. of Germany | 366/27 |
| 1422152 | 11/1965 | France | 52/192 |
| 21411 | 2/1978 | Japan | 366/255 |
| 2090761 | 7/1982 | United Kingdom | 366/20 |

*Primary Examiner*—Harvey C. Hornsby
*Assistant Examiner*—Joseph S. Machuga
*Attorney, Agent, or Firm*—Douglas L. Tschida

[57] ABSTRACT

A modularly constructed, trailerable, skid mounted, multi-compartmented concrete mixer and cement storage silo having a plurality of longitudinally aligned, bottom mounted, driven feed chains. In a combination construction, a single motor is cooperatively coupled to the feed chains of each mixer compartment and the feed chain of the cement silo to feed the cement/sand/aggregate in metered quantities to a turreted, separately powered auger where water is added and along the length of which the concrete is mixed. A silo vent column includes a plurality of fabric collection filters and means for vibrationally removing and reclaiming the cement. Air infiltration ports mounted along the bottom of the cement silo and one or more vibrators mounted to the mixer adjacent the sand and aggregate bins prevents crusting. Alternatively, the silo may be self-powered, and/or the mixer and silo may be transported independent of one another and/or without the trailer.

15 Claims, 6 Drawing Sheets

PORTABLE VOLUMETRIC CONCRETE MIXER/SILO

BACKGROUND OF THE INVENTION

The present invention relates to cement mixers and, in particular, to a modularly constructed, trailerable volumetric mixer having, in a combined construction, a cooperating cement storage silo and a single motor powered drive train. Improved filtration, cement lufting and vibrating means are also provided.

Concrete mixers may be found in a variety if sizes from small trailer mount units mixing less than a yard to multi-storied mixing plants where large trucks are loaded that convey multi-yard loads to work sites. Also known are various mid size mixers which may be transported to a job site for continuously or intermittently mixing necessary batches of concrete. It is of this latter type of mixer or a volumetric mixer to which the present invention pertains.

Commonly such mixers include a cement storage bin mounted in relation to separate sand and aggregate bins. As with Applicant's predecessor mixer, most such systems employ multiple drive motors to extract the cement/sand/aggregate and convey it to a mixing station, where another motor mixes the components. This is especially true where the storage bins are mounted in offset relation to the mixing station.

Although, Applicant's predecessor WDZ-100 model used a single motor in its mixer drive, it required a rather expensive gear reduction unit to separately power the cement feed portion of the drive train. It also required separate motors to feed the cement from a separate storage silo and to power a mixing auger. Preferably, however, a single drive motor and feed drive cooperating with the silo feed drive can achieve similar results with less expense and in a construction which is readily transportable to the job site.

SUMMARY OF THE INVENTION

It is accordingly a primary object of the present invention to provide a trailerable volumetric concrete mixer which may be configured to include a cement storage silo that cooperatively couples to the mixer feed drive without requiring an additional drive motor or gear reduction means.

It is a further object of the invention to provide a trailerable mixer and/or silo.

It is a further object of the invention to provide a self-powered silo construction.

It is a further object of the invention to provide a cement silo including a dust collection system whereby the dust is directed to a filtration, collection compartment wherefrom it may be periodically reclaimed.

It is further object of the invention to provide air infiltration ports along the cement silo for lufting the cement to prevent caking or clogging.

It is a further object of the invention to provide a chain coupled linkage between the cement mixing station and the cement storage silo.

It is a yet further object of the invention to provide a turreted mixing auger at the mixing station to facilitate loading of transport vehicles.

It is a still further object of the invention to provide sand and aggregate mixer bins including vibrators for preventing crusting.

Various of the above objects, advantages and distinctions of the invention are particularly achieved in a presently preferred construction which comprises a trailerable, skid mounted combination of a cement storage silo mounted in in-line relation to a mixer or blender station including integral side-by-side sand, cement and aggregate compartments. The mixer station may be used with or without the silo and with or without the trailer bed. Similarly, the silo may be self-powered and used independent of the mixer and/or trailer.

When combined, a single drive motor is chain coupled to a pair of overlying, endless, paddle member including feed chain assemblies. The feed assemblies mount interiorly of each storage compartment and draw the stored mixture components from the bottom of each compartment. The forward-end of the cement storage silo additionally includes a mating sprocketed transition drive chain which couples to the mixer's cement feed drive to simultaneously fill the mixer's cement hopper as its contents are drawn down during mixing. When the silo is used alone, a separate motor drives the silo feed chain. Controlled air infiltration, vibration and watering means facilitate mixing and storage. A reclamation vent means at the cement silo also reclaims cement dust at a plurality of vibrationally mounted fabric filters.

The foregoing objects, advantages and distinctions of the invention, among others, as well as a detailed description follows with respect to the appended drawings. Before referring thereto, it is to be appreciated the following description is made by way of the presently preferred embodiment only which should not be interpreted in limitation of the spirit and scope of the invention claimed hereinafter. To the extent modifications or improvements may have been considered, they are described as appropriate.

DESCRIPTION OF THE PREFERRED EMBODIMENT

Figure 1:
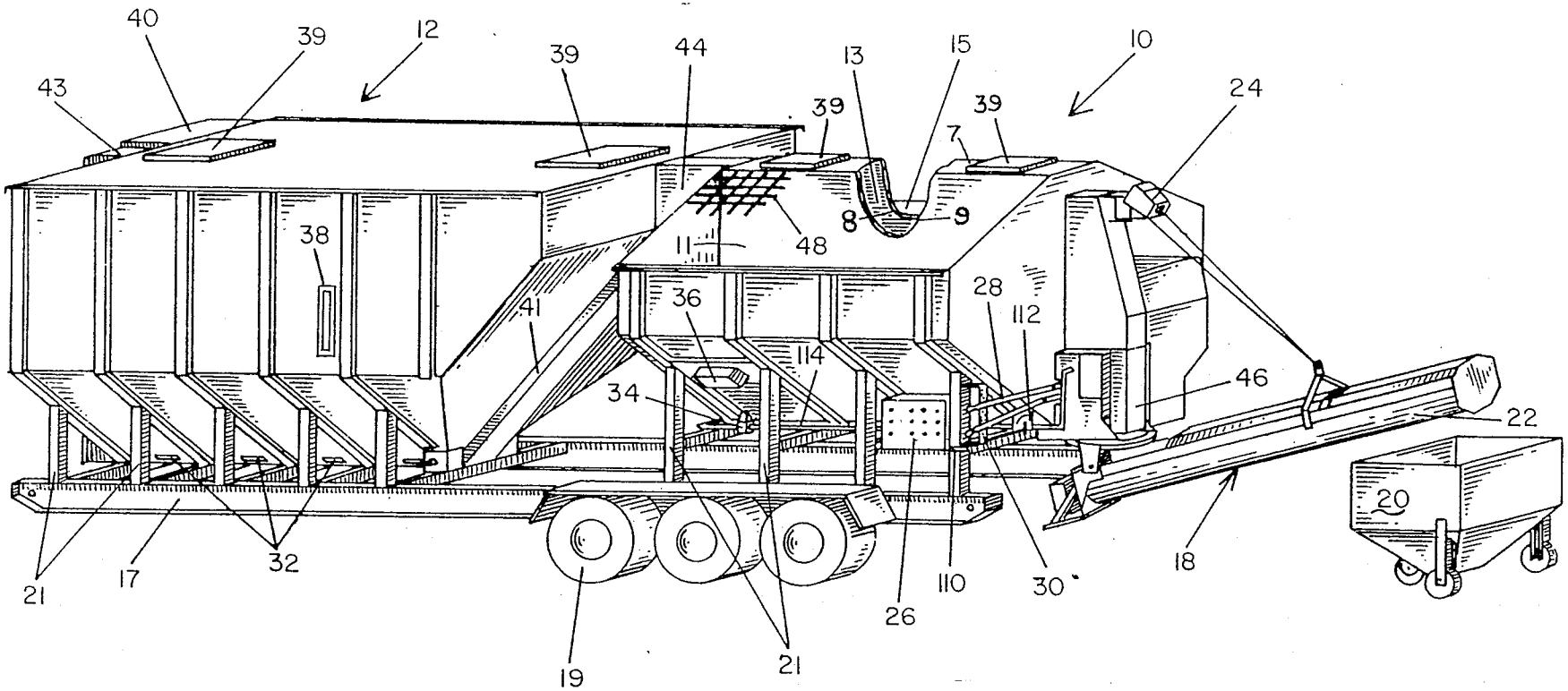
FIG. 1 shows an assembled isometric view of the combination construction of a trailer mounted volumetric mixer and in-line cement storage silo.

Referring to FIG. 1, an isometric assembly view is shown of the concrete mixing assembly of the present invention. In particular, it comprises a segregated, multi-compartmented mixer 10 having laterally adjacent sand, cement and aggregate compartments or hoppers 11, 13 and 15 which are shown in cutaway. Vertical partition walls 8,9, along with a bottom wall (not shown) and a top wall 7 isolate the hopper 13 from the sand and aggregate hoppers 11 and 15. A pair of feed chains, otherwise, are mounted to extend the length of the bottom of each hopper to deliver metered amounts of cement to separately controlled amounts of sand and aggregate.

Cooperatively coupled in in-line relation to the mixer 10 is a cement storage silo 12. Both the mixer 10 and silo 12 may be mounted to a continuous skid member 17, as shown, and/or may be secured to the platform of a trailer (not shown) having a number of axles for hauling the assembly to a particular work site by way of a tractor (not shown) mounted to the fore end of the trailer. If a full length skid 17 is used, it need merely be supported on a platformless axle assembly 19. Alternatively, individual bottom skid sections 17 can also be coupled to each unit 10 and 12 to permit independent movement of each unit about a work site.

As mentioned, chain driven feed assemblies mounted interiorly of the mixer 10, volumetrically supply predetermined amounts of cement, sand and aggregate to a separately powered auger assembly 18 which rotatively extends from the end of the mixer 10. The concrete is blended along the length of the auger 18 as the mixture components, including water, are supplied from the mixer 10 to the auger 18 at the in-feed end of the auger 18. A wheeled transport vehicle 20, which may comprise a manual or motorized vehicle or a crane supported bucket, receives the mixed concrete and conveys the concrete to the work area.

The cement is particularly ejected from the auger 18 at a cutout or outlet part (not shown) formed in the outer, lower end of the surrounding housing 22. Otherwise, the height of the outer end of the housing 22 relative to the ground is determined via a cabled crane assembly 24 mounted to the upper forward face of the mixer 10. Most commonly, the auger housing 22 is adjusted to angle upward in the range of ten to twenty degrees, although during transport is normally raised into abutment with the mixer 10 and secured to prevent swaying. Alternatively, the suger 18 may be removed during transport.

A control panel 26 mounted to the side of the mixer 10, adjacent a pair of handled lever arms 28 and 30 controls the operation of the cable crane 24, chain feed drives, air and water supplies, vibrators and the mixing auger 18. That is, a plurality of air infiltration ports 32 are provided along the length of the silo 12, while a water supply 34 is provided at the mixer 10 along with one or more vibrators 36. The lever arms 28 and 30, in turn, control the relative size of outlet ports 115 and 117 (reference FIG. 4) to the sand and aggregate hoppers 11 and 15 and thereby the respective quantity of and/aggregate material admitted relative to the cement which is fed at a rate determined by a separate chain feed drive. The details of various of the controlled equipment functions will be described hereinafter relative to the assembly components.

Preliminarily, however, it is to be noted that the cement silo 12 principally stores large quantities of cement on the order of 900 cubic feet, which cement is simultaneously admitted to the mixer 10 as cement is fed from the mixer's cement hopper 13. The cement hopper 13 is capable of holding approximately 60 cubic feet of cement and the sand and aggregate hoppers 11 and 15 each hold 343 cubic feet or enough for a limited number of batches with the assembly having a typical production capability of 20 to 24 cubic yards per hour of 5.5 bag per cubic yard cement. The silo feed drive is otherwise interconnected to and driven from the mixer's cement feed drive. A transparent sight window 38 is let into the outer side face of the silo 12 and permits viewing the status of its contents. A pair of hinged covers 39 also permit inspection from the top. Similar inspection covers 39 are also provided in the top 7 of the cement hopper 13.

Figure 2:
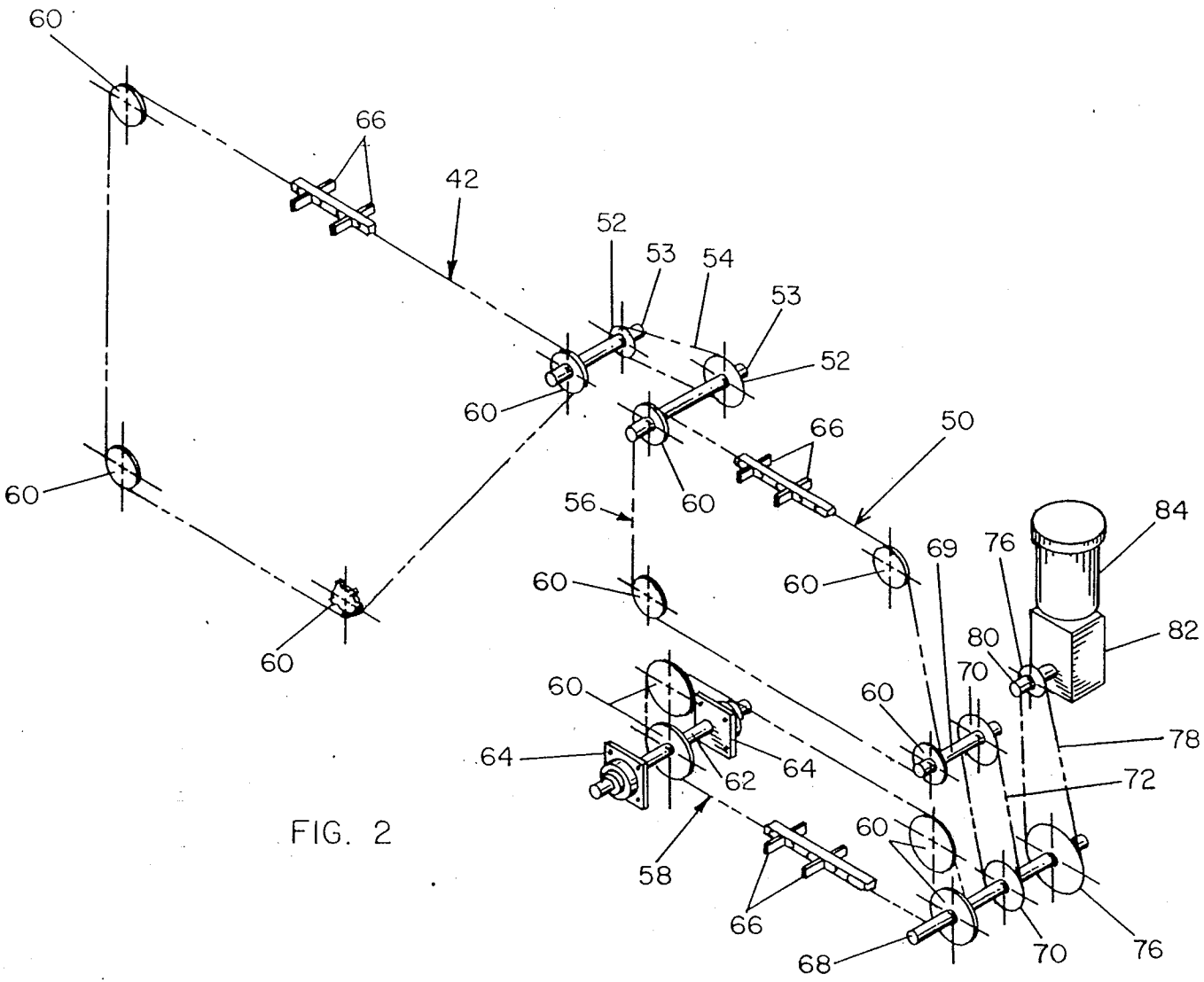
FIG. 2 shows an isometric view in exploded assembly of the cooperating feed drives of the present mixer and cement silo.

Extending downward from the upper rear surface of the silo 12 is a filtration system 40 which will be described in detail with respect to FIG. 3. Otherwise, a longitudinally mounted interior feed chain 42 (which is shown in FIG. 2) draws the cement from the bottom of the silo 12 upward to a transition compartment 44 where it is transferred to the mixer's cement hopper 13. The air infiltration ports 32, provided along the bottom of the silo 12, admit air to the stored cement to luft the cement and prevent caking. Channelways 41 and 43 let in the front and rear surfaces of the silo 12 constrain the feed chain 42 over a portion of its travel path.

The mixer 10 receives the cement at its center hopper 13 where a longitudinally extending feed chain directs the cement from the hopper 13 to the forward center face of the mixer 10 and outlet port 119 (reference FIG. 4) where it is ejected and allowed to fall into the lower lying auger 18. Simultaneously, the sand and aggregate from the mixer compartments 11 and 15 are added along with predetermined quantities of water via a funnelled and enclosed feeder section 46 which will be discussed in greater detail relative to FIG. 5.

Although the sand and aggregate hoppers 11 and 15 contain sufficient quantities of these mixture components for a limited batch, in normal use they are frequently filled by a mixer attandant. Large porous, hinged gratings 48 (a portion of only one of which is shown) cover the sand and aggregate hoppers 11 and 15 and break up clumps of the material as it is poured into the hoppers. Otherwise, the vibrators 36 mounted to the outer hopper walls induce agitation of the contents to prevent crusting and/or, should the water content of the sand and gravel be high enough relative to the ambient temperature, to prevent freezing.

Secured to the bottom vertical struts 21 of the storage silo 12 and mixer 10 is, as mentioned, a continuous length skid member 17 which rests on a multi-wheeled axle assembly 19. Once located at the site, the axle assembly 19 is typically removed from the trailer and the skid 17 rests on the ground.

Referring to FIG. 2, an isometric exploded assembly view is shown of the endless silo feed chain 42 and the mixer drive assembly 50 and their inter-coupling to one another. The mixer drive assembly 50 is divided into separate cement and sand/aggrgate drive portions that respectively include feed chains 56 and 58. All the feed chains 42, 56 and 58 are interconnected and longitudinally mount in co-planar relation to one another along longitudinal center axes of the cement silo 12 and mixer 10.

The silo feed chain 42 and mixer feed chain 56 are mounted to substantially circumscribe the interior of their associated storage compartment to agitate the cement at multiple levels as the cement is fed from the silo 12 to the to the mixer 10 and to the auger 18. An upper end portion of the silo feed chain 42 also mounts inside the transition compartment 44, where a pair of sprokets 52 which are coupled to a pair of transition shafts 53 and a linking chain 54 couple power from the mixer's cement feed chain 56 to the silo feed chain 42. Otherwise, the sand/aggregate feed chain 58 of the mixer 10 is mounted separately beneath the cement feed chain 56 to simultaneously feed sand and aggregate from the respective hoppers 11 and 13. That is, the opposite lateral sides of the feed chain 58 are exposed to each of the sand and aggregate hoppers 11 and 15 to simultaneously draw these mixture components to the outlet parts 115, 177 (reference FIG. 4).

Horizontally extending the length of the mixer's interior beneath the bottom of the cement hopper 13 are walled dividers (not shown) which define a return path for a portion of the sand/aggregate feed chain 58. Except in the area of this return path, the areas of interconnection, and a vertical access compartment (not shown) located at the rear of the mixer 10 beneath the transition compartment 44, like an access compartment 43 (reference FIG. 3) to the silo feed chain 42, the feed chains 56 and 58 are contained within their respective hoppers 13, 11 and 15. The silo access housing 43 and the unseen mixer access housing, oterwise, permit access to each of the feed chains 42, 56 and 58 for repair and periodic visual inspection to determine wear etc.

Each of the feed chains 42, 56 and 58 are trained about a plurality of multi toothed sprockets 60 which, for convenience, are shown in general outline and which are hardened to a 300 to 400 Bernell rating. Such a rating is required to withstand the abrasive environments within which they are mounted. Each sproket 60 is also mounted to a supporting axle 62 that is suspended between a pair of laterally disposed slide adjustable, four-bolt flange bearings 64 that are secured to the outer walls of the silo 12 and mixer 10. For convenience, only one of the axles 62 and one pair of bearings 64 are shown. Otherwise, each of the transition shafts are shown, where the feed chains are interconnected or coupled power from a drive motor 84, and will be discussed below, but which merely comprise longer axle shafts.

Each length of chain 42, 56 and 58 includes a plurality of pairs of opposed lateral paddle members 66 which are welded to the chain links and extend approximately four to six inches to each side. The paddles 66 are vertically mounted on edge and stand approximately two inches tall; although could be taller. They operate to draw encountered materials from the bottoms of each hopper 11, 13 and 15 and silo 12. Whereas the cement feed chains 42 and 56 are fully exposed to the cement within their hoppers 13 and 12, only one side of the paddles 66 on the feed chain 58 are exposed to the sand with the other side exposed to the aggregate.

Turning attention next to the forward drive end of the mixer feed chains 56 and 58. Each includes a sloped vertical transition region and to the lower forward apex of which the sand/cement/aggregate is drawn and whereat the outlet port openings 115, 117 and 119 in fore-end wall of the mixer meter the materials into the auger 18. It is at the apex sprockets 60 where the mentioned longer transition drive shafts 68 and 69 mount and support one or more transition drive sprockets. One pair of transition drive sprockets 70 and interconnecting chain 72 particularly transfer drive power from the sand/aggrgate feed chain 58 to the cement feed chain 56. Otherwise, a second pair of transition drive sprockets 76 and chain 78 extend between the drive shaft 68 and a drive shaft 80 of a right angled reducer assembly 82. The drive motor 84 is secured to the upper end of the reducer 82.

Drive power is thus fed from the motor 84 to the reducer 82 and via the transition chains 78,72 and pairs of transfer sprockets 76,70 and drive shafts 80, 68 and 69 to the sand-aggregate and cement chains 58,56. The further pair of transition sprockets 52 and transition chain 54 in the transition compartment 44 couple the silo feed chain 42 and mixer cement feed chain 56 to one another.

Applicant's predecessor mixer, although using a single motor 84, also used a gear reduction unit (not shown) intermediate the drive motor 84 and a transversely mounted cement feed chain 56, which allowed Applicant to vary the rate at which cement was fed from an independent cement hopper. Such a reduction unit however is rather costly and Applicant has determined that it may be deleted from the present mixer 10 without adversely affecting performance. Applicant now merely adjusts the size of the outlet port openings 115 and 117 of the sand and aggregate bins which varies the corresponding concentration relative to a constant cement delivery rate. Moreover, by coupling the storage silo feed 42 and cement mixer feed 58 to one another in the fashion of FIG. 2, a synchronous feed is obtained without the further requirement of a separate drive motor at the storage silo 12. In short, an improved, less costly combined feed drive is obtained.

Figure 6:
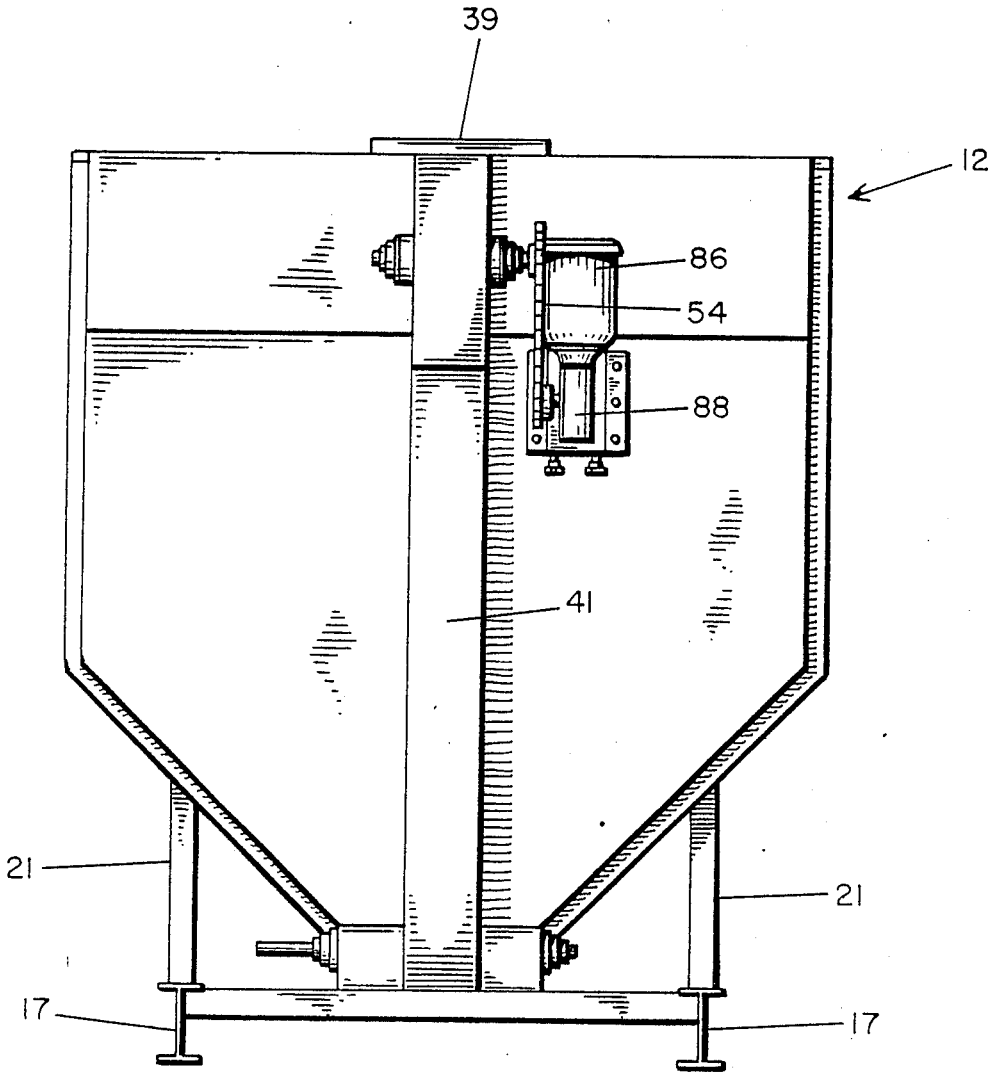
FIG. 6 shows a front view of a self-powered silo.

Although too Applicant's silo 12 ideally is mounted in combinatioon with the mixer 10, it can be used independently. In this instance and with attention to FIG. 6, a view is shown of the front of such a silo 12. The silo is identical to that shown in FIG. 1, except a separate motor 86 and right angle reducer 88 are coupled to the transition chain 54. Drive power is thus obtained from the additional motor 86 in lieu of the mixer motor 84. The tension of the chain 54 is adjusted via a slide plate assembly which will be described in greater detail below relative to the reducer 82.

Figure 3:
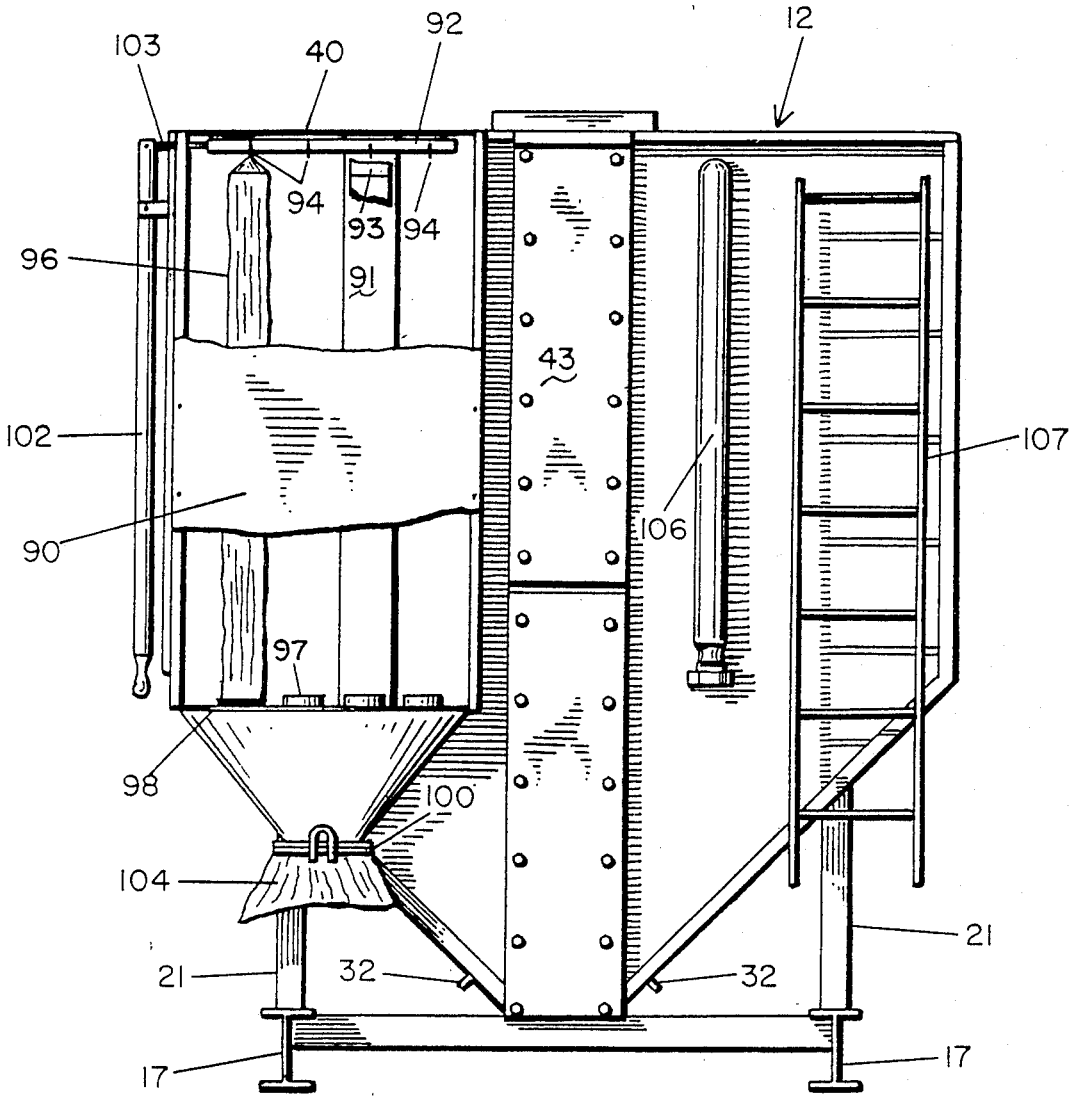
FIG. 3 shows a rear elevation view of the cement silo.

Turning attention next to FIG. 3, a rear elevation view is shown of the cement storage silo 12 and of the dust filtration/reclamation assembly 40 secured thereto. This assembly generally includes an outer housing 90 which extends full height along the rear of the silo 12. Mounted interiorly at the upper end of the enclosure 90 is a plate member 92 including a plurality of hooks 94 which are secured to the closed ends of a plurality of loosely woven bags 96 (only one of which is shown) suspended therefrom. The open end of each bag 96 is mounted to a separate annular through collar 97 of a multi-collared flange plate 98 secured in the bottom of the enclosure 90 and beneath which is mounted a clamped funnel assembly 100. A handled rod member 102 and interconnecting linkage 103 pivotally secured to the upper plate member 92 is operable to jog the plate member 92 back-and-forth to jostle the suspended bags 96 and release any dust which has collected in a bag 104 secured to the funnel assembly 100.

In particular, as cement dust rises in the silo 12, it is passively conveyed downward via a verticle channelway 91 in the enclosure 90, the interior of which is exposed to an aperture 93 at the top of the silo 12, to a region of the funnel assembly 100 between the flange 98 and the reclamation bag 104. There a portion of the dust is directly conveyed into the bag 104. Otherwise, a portion of the dust rises upward through the collars 97 of the collared flange 98, with the dust collecting on the interiors of the plurality of bags 96. As the dust collects and cakes on the inside of the bags 96, some falls back through the collared flange 98 into or directly enters the reclamation bag 104 supported from the clamped funnel 100. Otherwise, the mixer attendant, periodically operates the rod 102 to shake the coated dust from the filtration bags 96 into the reclamation bag 104. Once the bag 104 is sufficiently filled, the reclaimed cement is readded to the silo 12.

In lieu of the foregoing manual assembly, it is to be appreciated a timed automatic vibrator, like the vibrator 36, might be coupled to the plate 92 in lieu of or in addition to the manual jogger rod 102 to periodically shake the collected dust from the bags 96. Moreover, in lieu of a collection bag 104, a separate collection bin and feed might be employed to collect and redeposit the cement back into the silo 12.

Also, more apparent form FIG. 3 are a pair of the air infiltration ports 32 which are mounted on the right and left sides of the silo bottom. These ports are coupled to a suitable pressurized air supply providing air on a continual basis to the interior of the silo to prevent crusting. A solenoid controlled valve (not shown) intermediate the air supply and outlet ports 32 is controllable from the control panel 26. Otherwise, also shown are a silo filler tube 106 and access ladder 107.

Figure 4:
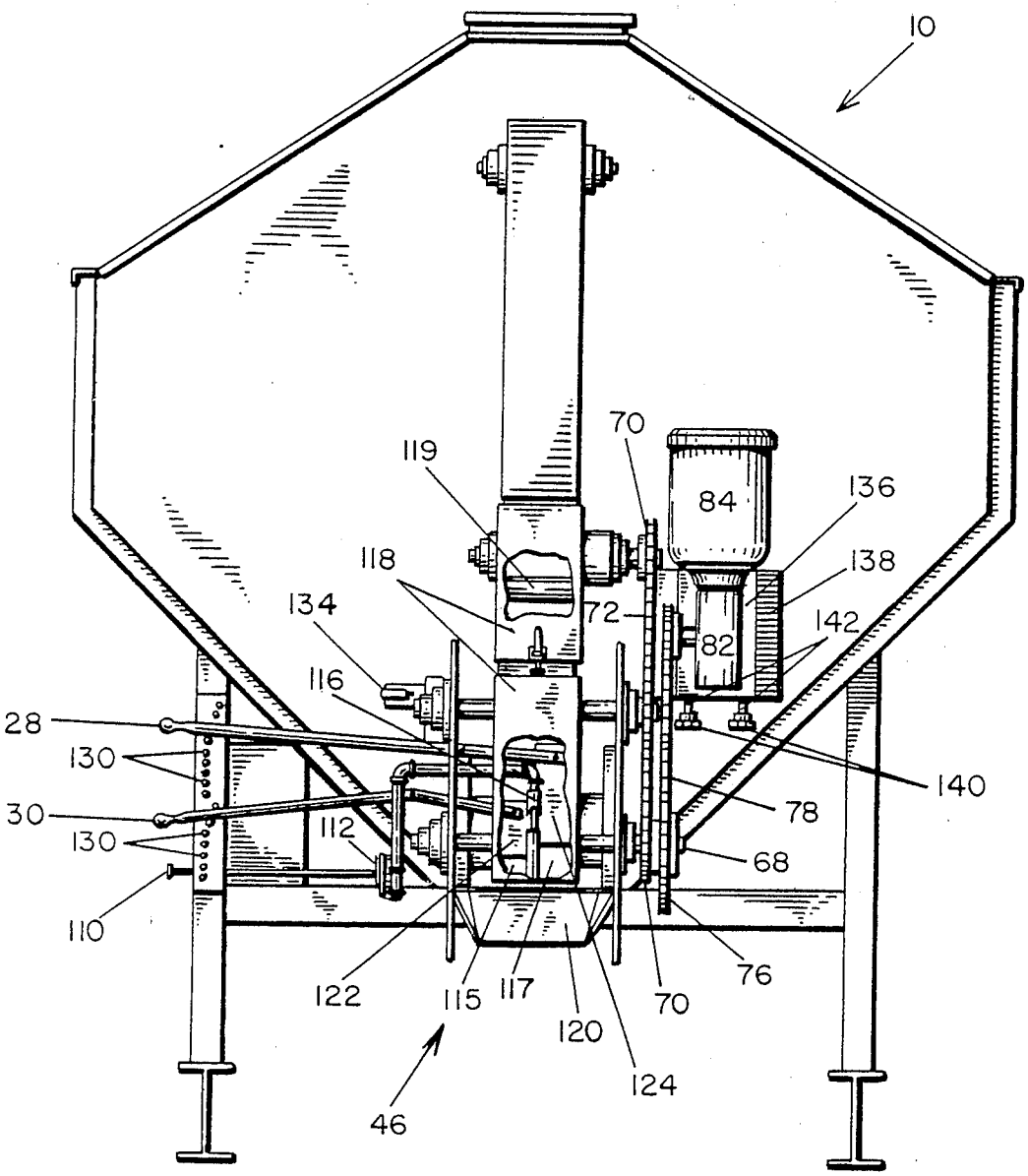
FIG. 4 shows a front elevation view of the mixer.

In a similar fashion to the air supply and with attention re-directed to FIG. 1 and FIG. 4, a water inlet valve 34 is provided at the rear of the mixer 10 with an intermediate solenoid valve (not shown) being controlled from the control panel 26. A manual shut-off handle 110 extends form the mixer side to a valve having a metered control face 112 which also controls the water supply line 114 and meters an appropriate amount of water relative to an end mounted spray nozzle 116.

The nozzle 116 is positioned at the forward end of the mixer 10, immediately in front of the sand, aggregate and cement outpet ports 115, 117 and 119 which can be seen in cutaway through covering access panels 118. A fan spray pattern is proivided from the nozzle 116 which wets the mixture components as they are added to the auger 18 and also knocks down any dust which might be created. A conical rubber shroud 120 funnels the components into the auger 18 and surrounds the adjacent area to further control against dust build up in the feeder compartment 46.

A better view is obtainable from FIG. 4 of the realative mountings of the transition sprockets 70,76 and chains 72,78 relative to one another and to the apex sprockets 60 of the cement and sand/aggregate feed chains 56 and 58. Also apparent from this view are the shuttered gates 122 and 124 to the outlet ports 115 and 117 of the sand and aggregate hoppers 11 and 15 and the mannual control arms 28 and 30 for raising/lowering same. The outer ends of each arm 28 and 30 also includes a pin member (not shown) which mates with an elected hole 130 on an adjacent support member 21. The hole patterns coincide with specifically determined gate opening sizes and thus the operator is able to selectively meter the sand and aggregate relative a specific hole setting. The cement, in turn, is metered via a counter 134 coupled to the apex feed sprocket 60 of the cement feed chain 56.

With attention next directed to the right angle reducer assembly 82, it is mounted to a plate member 136 which is slideably adjusted between right and left lateral slide irons 138. A pair of flanges 140 welded to the mixer 10 and threaded members 142 mounting therethrough and contacting the edge of the slide plate 136 permit adjustment of the tension on the transition chain 78. A similar adjustment assembly is provided at the reducer 88 of FIG. 6 and each of the four bolt flange bearings 64 supporting the opposite ends of the shafts which support the feed sprockets 60. The tension of the feed chain assemblies 42, 56 and 58 are thus asjustable at a plurality of points.

Figure 5:
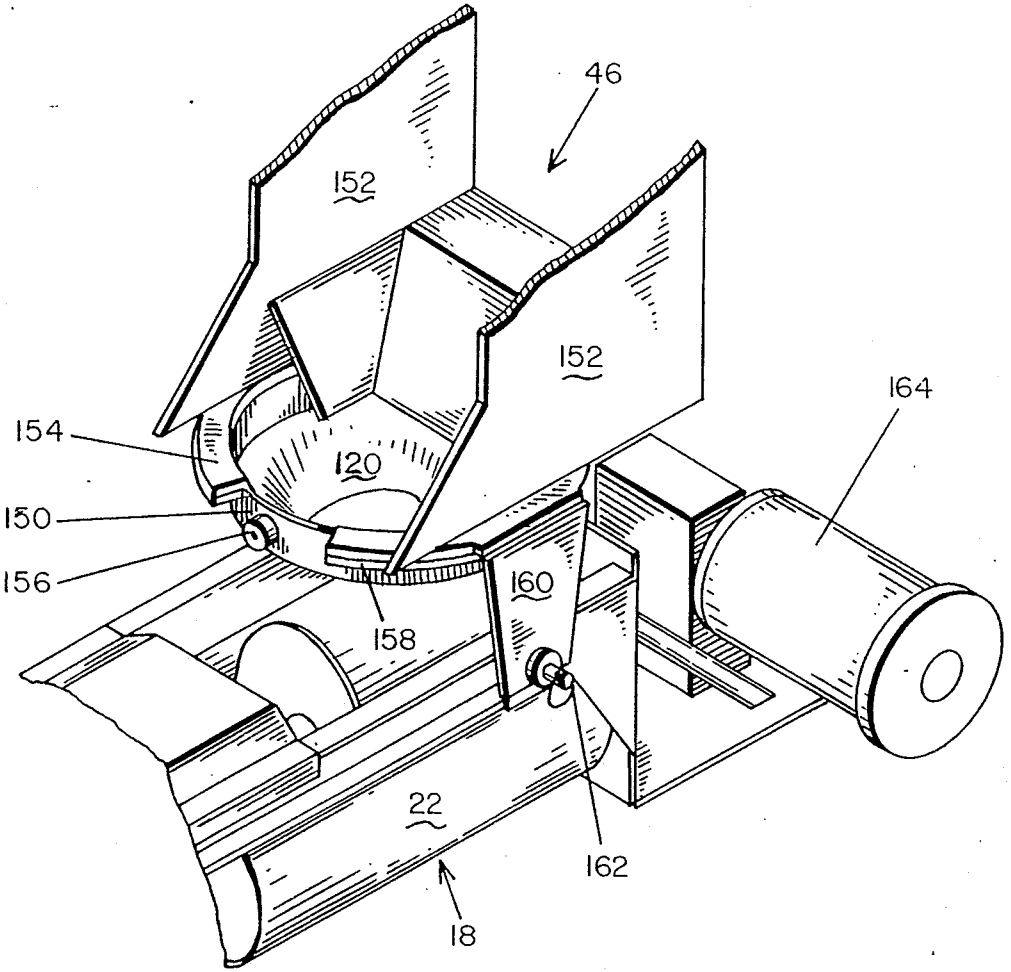
FIG. 5 shows an isometric view of the turreted mounting of the mixing auger to the mixer.

With further attention directed to FIG. 5, an isometric view is shown in partial section of the turreted turntable 150 provided at the inner end of the auger 18 where it mounts to the mixer 10. Secured to the lower ends of a pair of lateral support members 152 which also support the apex sprockets 60 of the feed chains 56,58 in alignment with the feeder compartment, is a circular flanged collar 154. Tapering in concentric relation from the bottom of the collar 154 is the rubber funnel 120 which funnels the mixture components into the auger 18. Otherwise, radially extending from the sides of the flanged collar 154 are a number of roller bearing members 156 which mate with a separate collar flange member 158 which is supported from a pair of vertical plates 160 extending upward from the auger 18. the auger flange 158 is thus rotatively supported above the various rollers 156 beneath the plate 154 to slide therebetween as the auger 18 is rotated right or left. An approximate rotation angle of 180 degrees is thus obtained which provides greater freedom in loading the transport vehicles 20.

In passing, it is again to be appreciated that the auger 18 is separately powered via a motor 162, although control to the auger motor 162 occurs at the control panel 26. Accordingly, switches are provided to permit a "continuous" auger operation or a "jogging" operation, such as when the mixture slump is first being established or during batch mixes. Also apparent are the linch pins 162 which secure the auger 18 to the plates 160 and mixer 10 and permit detachment of the auger 18.

While the present invention has been described with respect to its presently preferred and various alternative embodiments, it is to be appreciated still other embodiments might suggest themselves to those skilled in the art upon exposure thereto. Accordingly, it is contemplated the following claims should be interpreted to include all those equivalent embodiments within the spirit and scope thereof.

What is claimed is:

1. A storage silo comprising:

(a) an enclosure having front and rear end walls, a top and a bottom wall, and vertical side walls defining an interior cavity and a channelway extending along the bottom and front end wall;

(b) an endless chain trained about a plurality of sprockets rotatively supported from ones of the enclosure walls and extending along said channelway;

(c) a plurality of vertical paddle members extending from opposite lateral sides of said chain;

(d) an enclosed vent housing having a plate member including a plurality of apertures separating an interior of said vent housing into upper and lower portions and including a plurality of bag members each having an open end in communication with one of said apertures and a closed end secured to a vibrating means, means in communication with the interior of said enclosure for passively conveying dust to the lower portion and further including means coupled in communication with the lower portion for collecting dust from said dust conveying means and matter vibrated from said plurality of bags;

(e) means for admitting pressurized air through the bottom of said storage enclosure; and (f) means for driving said chain to convey stored contents to a discharge port.

2. Cement mixing apparatus comprising:

(a) an enclosure having at least first, second, and third laterally displaced bin portions, wherein the bottom of the first and second bin portions share a bottom wall of said enclosure and each of said first and second bin portions communicate with respective first and second discharge ports at an enclosure end wall and a third discharge port of the third bin portion is mounted in overlying displaced relation to said first and second discharge ports and further including first and second endless chains mounted in coplanar longitudinal overlying relation to one another with said first chain communicating with said first and second bin portions and said second feed chain extending in substantially circumscribing relation interiorly of said third bin portion and in communication with said third discharge port;

(b) a plurality of paddle members extending from opposite lateral sides of said first and feed second chains;

(c) a first motor;

(d) means for coupling said first and second chains to one another and to said motor such that said first and second chains convey materials contained in said first, second and third bin portions to first, second and third outlet ports opening to said first, second and third bin portions;

(d) means for controlling the aperture size of said first, second discharge ports;

(e) a driven screw auger mounted beneath said first, second and third discharge ports including an annular flange;

(f) means for admitting water to said mixture components at said auger; and (g) an annular flange including a plurality of bearing members radially extending from vertical side walls and whereupon the annular flange of said auger rest whereby said auger may be rotated relative to said mixing apparatus.

3. Cement mixing apparatus comprising:

(a) a storage enclosure having top, bottom, side fore and aft end walls and including a first endless chain longitudinally extending in substantially circumscribing relation interiorly of said enclosure, wherein said first chain includes a plurality of paddle members laterally extending from the sides of said first chain and mounted such that said paddle members draw a contained mixture component to an outlet port at an upper portion of the fore end wall;

(b) a mixer enclosure including (a) fore and aft end walls and having at least first, second and third laterally adjacent bin sections, each bin section defined by a plurality of walls extending between said fore and aft end walls, (i) wherein a bottom portion of said mixer cnclosure defines a bottom of each of the first and second bin sections, (ii) wherein said first and second bin sections terminate at first and second discharge ports in said fore end wall, (iii) wherein the third bin section is mounted in isolated overlying relation between said first and second bin sections and includes an inlet port at an aft end of a top wall positioned substantially adjacent the outlet port of said storage enclosure and a third discharge port in said fore end wall above said first and second discharge ports, and further including (b) second and third endless chains longitudinally extending interiorly of said mixer enclosure in coplanar relationto said first chain, (i) wherein each of said second and third chains includes a plurality of laterally extending paddle members, (ii) wherein a portion of travel path of said second chain is in communication with each of said first and second bin sections and said first and second discharge ports and said third chain extends in substantially circumscribing relation interiorly of said third bin section and in communication with said third discharge port;

(c) a motor;

(d) means for coupling said second and third chains to one another and to said motor and said first chain to said second chain, whereby said first chain delivers a mixture component from said storage enclosure simultaneously to said third bin section as said third chain delivers material from said third discharge port and whereby mixture components contained in said first and second bin sections are drawn by the second chain to said first and second discharge ports; and (e) driven screw auger means mounted beneath said first, second and third discharge ports for mixing mixture components exiting said first and second discharge ports.

4. Apparatus as set forth in claim 3 wherein said storage enclosure includes a vent chamber having an upper and a lower portion separated by a first plate member including a plurality of collars projecting therefrom in alignment with a plurality of through apertures, means mounted in said upper portion and supporting a closed end of a plurality of bags, an open end of each of said bags being secured about one of said collars, means in communication with the interior of said storage enclosure for conveying dust to said lower portion, collection means coupled to said lower portion to collect dust and particulates and means for vibrating said support means whereby matter collecting interiorly of each of said bags is jostled free to fall into said collection means.

5. Apparatus as set forth in claim 4 wherein said conveying means comprises an enclosed conduit passively coupling cement dust from the top of said storage enclosure downward to said lower portion and into said collection means and said plurality of suspended fabric bags.

6. Apparatus as set forth in claim 3 including a plurality of inlet ports in communication with the bottom interior of said storage enclosure and means for admitting pressurized air via said inlet ports interiorly of said storage enclosure.

7. Apparatus as set forth in claim 3 wherein said storage enclosure and said mixer enclosure are mounted to a pair of skid members and said skid members are supported on a multi-axled trailer.

8. Appratus as set forth in claim 3 wherein said mixer enclosure includes means for distributing a measured quantity of water adjacent said first and second discharge ports.

9. Apparatus as set forth in claim 3 including:

(a) means for controlling the aperture size of said first, second and third discharge ports;

(b) means for admitting water to said mixture components at said auger means; and (c) a circular flange including a plurality of bearing members radially extending therefrom and wherein said auger means includes a mating circular flange mountable on said bearings members and whereby said auger may be rotated relative to said mixer enclosure.

10. Apparatus as set forth in claim 3 wherein said chain coupling means comprises:

(a) a right angled gear reducer coupled to a drive shaft of said motor;

(b) a first pair of transition sprockets each coupled to one of an output shaft of said right angle reducer and a shaft supporting a pulley of said second chain and a first transition chain interconnecting said first pair of transition sprockets; and (c) a second pair of transition sprockets each coupled to one of a sprocket supporting shaft of said second chain and a shaft supporting a pulley of said third chain and a second transition chain interconnecting said second pair of transition sprockets.

11. Apparatus as set forth in claim 10 inlcuding:

(a) a third pair of transition sprockets, each coupled to one of a sprocket-supporting shaft of said third chain and a sprocket supporting shaft of said first chain feed and a third transition chain interconnecting said third pair of transition sprockets; and (b) wherein each of said first, second and third chains is mounted in co-planar relation to one another along the longitudinal center axis of said storage enclosure and mixer mixer enclosure.

12. Apparatus as set forth in claim 3 wherein said first and second bin sections include hinged grate cover members having a plurality of apertures and wherethrough mixture components may be added, and wherein said third bin section and said storage enclosure each include at least one inspection port.

13. Apparatus as set forth in claim 3 including (a) a first annular flange having a bore positioned beneath said first and second discharge ports and a plurality of bearing members, each bearing member rotatably supported on an axle radially extending from an outer wall of said first flange;

(b) a second annular flange having a support surface resting on said plurality of bearing members and secured to said driven screw auger means and wherein said auger means includes a lengthwise enclosure having a first opening at one end mounted in alignment with said bore to receive said mixture components and a second opening at an opposite end whereat blended concrete is discharged.

14. Apparatus as set forth in claim 3 including a conical rubber funnel member secured to said first circular flange to convey mixture components to said first opening.

15. Cement mixing apparatus comprising:

(a) a mixer enclosure including fore and aft end walls and having at least first, second and third laterally adjacent bin sections, each bin section defined by a plurality of walls extending between said fore and aft end walls, (i) wherein a bottom portion of said mixer enclosure defines a bottom of each of the first and second bin sections, (ii) wherein said first and second bin sections terminate at first and second discharge ports in said fore end wall, (iii) wherein the third bin section is mounted in isolated overlying relation between said first and second bin sections and includes an inlet port at an aft end of a top wall and a third discharge port in said fore end wall above said first and second discharge ports, and further including first and second endless chains longitudinally extending interiorly of said mixer enclosure in coplanar relation to one another, (i) wherein each of said first and second chains includes a plurality of laterally extending paddle members, (ii) wherein a portion of a travel path of said first chain is in communication with each of said first and second bin sections and said first and second discharge ports and said second chain extends in substantially circumscribing relation interiorly of said third bin section and in communication with said third discharge port;

(b) a motor;

(c) means for coupling said first and second chains to one another and to said motor whereby mixture components contained in said first and second bin sections are simultaneously drawn by the first chain to said first and second discharge ports as the second chain draws mixture components to the third discharge port; and (d) driven screw auger means mounted beneath said first, second and third discharge ports for mixing mixture components exiting said first, second and third discharge ports.

* * * * *